US009539835B2

(12) United States Patent
Kinas

(10) Patent No.: US 9,539,835 B2
(45) Date of Patent: Jan. 10, 2017

(54) CALIBRATION APPARATUS

(71) Applicant: HEWLETT-PACKARD DEVELOPMENT COMPANY, L.P., Houston, TX (US)

(72) Inventor: Erick Blane Kinas, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1078 days.

(21) Appl. No.: 13/688,551

(22) Filed: Nov. 29, 2012

(65) Prior Publication Data

US 2014/0149068 A1 May 29, 2014

(51) Int. Cl.
*B41J 11/46* (2006.01)
*B41J 25/00* (2006.01)

(52) U.S. Cl.
CPC ..... *B41J 25/00* (2013.01); *B41J 11/46* (2013.01)

(58) Field of Classification Search
CPC ..... G01B 11/00; B41J 25/00; B41J 25/001; B41J 11/46; B41J 11/00; B65H 7/00; B65H 7/02; B65H 7/14
See application file for complete search history.

(56) References Cited

U.S. PATENT DOCUMENTS 5,805,183 A 9/1998 Lidke et al.
6,076,915 A 6/2000 Gast et al.
6,940,618 B2 9/2005 Kinas
8,152,262 B2 4/2012 Seccombe
2010/0078870 A1* 4/2010 Fellingham ..... B41J 2/2132 271/8.1

OTHER PUBLICATIONS

DisplayMate Technologies Corporation. 1990-2011. Calibrating Your Printer with DisplayMate Comprehensive Long Version. www.displaymate.com/prtcal1.html.

* cited by examiner

*Primary Examiner* — Toan Le
(74) *Attorney, Agent, or Firm* — HP Inc. Patent Department

(57) ABSTRACT

A calibration apparatus is disclosed herein. An example includes a printing mechanism, a media control mechanism, a sensor, and a processor. The processor controls the printing mechanism to print a first pattern of first elements on a print medium and a second pattern of second elements on the print medium that are interleaved with the first elements. The processor also actuates the media control mechanism to advance the print medium, determines a centroid of at least one of the first elements based on a first measured reflectance by the sensor, and determines a centroid of at least one of the second elements based on a second measured reflectance by the sensor. The processor also determines a print medium advance error based on the at least one determined centroid of the first elements and the at least one determined centroid of the interleaved second elements.

20 Claims, 10 Drawing Sheets

CALIBRATION APPARATUS

BACKGROUND

Consumers appreciate quality and performance in their printing devices. They also appreciate the ability to calibrate and update their devices to help maintain such quality and performance. Designers and manufacturers may, therefore, endeavor to create or build printing devices directed toward these objectives.

BRIEF DESCRIPTION OF THE DRAWINGS

The following detailed description references the drawings, wherein.

DETAILED DESCRIPTION

Printing devices rely on print media advance accuracy to produce quality output. Print medium advance error reduces such output quality. For example, over feed of a print medium can cause white line banding. As another example, under feed of a print medium can cause dark line banding.

One technique to address print medium advance error involves calibration of the print media path during manufacture. This technique can be expensive due to things such as space and operator needs. This technique also does not address aging and wear that naturally occurs over the life of a printing device. This wear and aging can change the friction provided by the media rollers and also affect gear train advancement accuracy over the life of a printing device, thus requiring recalibration.

Another technique to address print medium advance error involves use of a pattern referred to as Swath Height Error-Linefeed Advance Calibration ("SHELAC"). SHELAC utilizes an interference pattern of lines that are printed on a print medium by two different portions of a printing mechanism. The interference pattern works by trying to find a location where the lines printed with one part of the printing mechanism line up with the lines printed with the other portion of the printing mechanism. At this portion of the interference pattern, there is more print medium showing which is perceived to be lighter or of a higher reflectance. A sensor can detect this lightness or brightness level and, therefore, detect the best alignment.

While SHELAC works well under ideal conditions, unfortunately, with actual printing device settings, there can be issues. For example, the printing mechanism can have small vibrational movements in the print media advancement path direction. These vibrations can cause horizontal lines across a print medium to move up and down which can adversely affect accurate measurement of the interference patterns. An example of another potential issue with such interference patterns is that the measurement change from one step to the next is the nozzle resolution for printing mechanisms that utilize ink jet print heads. On higher-end print heads, this currently translates to 1/1200th of an inch. Greater resolution can be attained by interpreting the scan value of neighboring steps but because the fundamental accuracy is not great, this is almost impracticable.

Figure 1:
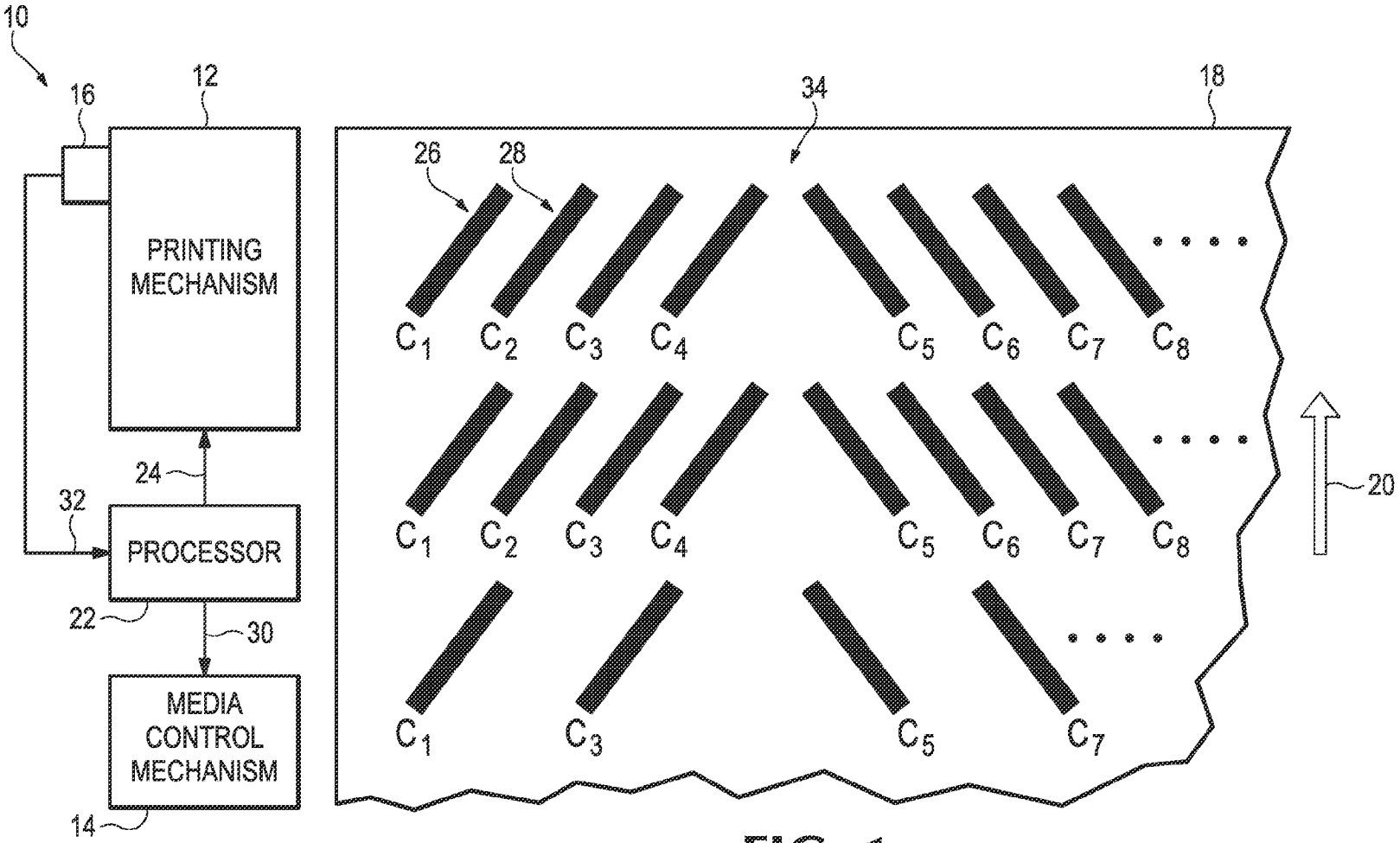
FIG. 1 is an example of a diagram of a calibration apparatus for use in a printing device.

An example of a calibration apparatus 10 for use in a printing device that is directed to addressing these challenges is illustrated in FIG. 1. As used herein, the term "non-volatile storage medium" is defined as including, but not necessarily being limited to, any media that can contain, store, or maintain programs, scripts, information, and/or data. A non-volatile storage medium may include any one of many physical media such as, for example, electronic, magnetic, optical, electromagnetic, or semiconductor media. More specific examples of suitable non-volatile storage media include, but are not limited to, a magnetic computer diskette such as floppy diskettes or hard drives, magnetic tape, a random access memory (RAM), a read-only memory (ROM), an erasable programmable read-only memory (EPROM), a flash drive, a compact disc (CD), or a digital video disk (DVD).

As used herein, the term "processor" is defined as including, but not necessarily being limited to, an instruction execution system such as a computer/processor based system, an Application Specific Integrated Circuit (ASIC), a computing device, or a hardware and/or software system that can fetch or obtain the logic from a non-volatile storage medium and execute the instructions contained therein. "Processor" can also include any controller, state-machine, microprocessor, cloud-based utility, service or feature, or any other analogue, digital and/or mechanical implementation thereof.

As used herein "printing device" is defined as including, but not necessarily being limited to, a printer, plotter, or press that uses any of the following marking technologies or a combination thereof: ink jet, laser jet, dye sublimation, liquid toner, off-set printing, or dot matrix. As used herein "media" "medium", "print media", and "print medium" are defined as including, but not necessarily being limited to, any type of paper or other printing medium (e.g., cloth, canvas, transparency, etc.), having any type of finish on either or both sides (e.g., glossy, matte, plain, textured, etc.), in any size, shape, color, or form (e.g., sheet, roll (cut or uncut), folded, etc.) on which printing composition (e.g., ink, toner, colorant, wax, dye, etc) is placed, jetted, deposited, dropped, or laid to form one or more images (e.g., text, graphics, pictures, formulas, charts, etc.).

As used herein, "printing mechanism" and "print mechanism" are defined as including, but not necessarily being limited to, any of the following marking technologies and associated components, or a combination thereof: ink jet and associated print head(s) (thermal, piezoelectric, etc.), laser jet, dye sublimation, liquid toner, off-set printing, or dot matrix. As used herein, "media control mechanism" is defined as including, but not necessarily being limited to, the gear train, motor(s), encoder(s), and rollers used to advance and control the movement of print media past a printing mechanism of a printing device.

As used herein, "sensor" is defined as including, but not necessarily being limited to, a device and associated electronics that transmit, direct, refract and/or reflect light or other electromagnetic energy toward printing composition on a print medium and/or detect the quantity or amount of light or other electromagnetic energy reflected from or absorbed by the printing composition on the print medium. The sensor may be an integrated element or composed of separate elements. Additionally, all or part of the sensor may be coupled to or separate from the printing mechanism.

As used herein, "centroid" is defined as including, but not necessarily being limited to, a best fit center of mass of a signal response of a sensor. Referring again to FIG. 1, calibration apparatus 10 includes a printing mechanism 12, a media control mechanism 14, and a sensor 16. In this example of calibration apparatus 10, printing mechanism 12 includes one or more ink jet print heads that are mounted to a carriage (not shown). The one or more ink jet print heads may be designed in a page-wide array arrangement with a stationary carriage that is used to hold them or they may be smaller than page-wide and mounted in a carriage that slews back and forth across a print medium 18, as discussed more fully below.

Media control mechanism 14 advances and controls the movement of print media, such as print medium 18, past printing mechanism 12 of a printing device in the direction generally indicated by arrow 20, so that printing composition may be deposited thereon to create a calibration pattern, as discussed more fully below. Also in this example of calibration apparatus 10, sensor 16 is coupled to printing mechanism 12 (e.g., by being mounted on the carriage (not shown) holding printing mechanism 12) to measure reflectance from print medium 18, as also discussed more fully below.

As can also be seen in FIG. 1, calibration apparatus 10 additionally includes a processor 22 to control printing mechanism 12, as generally indicated by arrow 24, to print a first pattern 26 of first elements $C_1$, $C_3$, $C_5$, and $C_7$ on print medium 18 (in this example diagonal lines) and a second pattern 28 of second elements $C_2$, $C_4$, $C_6$, and $C_8$ on print medium 18 (also diagonal lines in this example) that are interleaved with first elements $C_1$, $C_3$, $C_5$, and $C_7$ of first pattern 26. Processor 22 also actuates media control mechanism 14 to advance print medium 18 in the direction of arrow 20, as generally indicated by arrow 30.

As discussed more fully below, processor 22 is also designed to determine a centroid of at least one of the first elements $C_1$, $C_3$, $C_5$, and $C_7$ of first pattern 26 based on a first measured reflectance by sensor 16, which is transmitted, conveyed, or communicated to processor 22, as generally indicated by arrow 32, in the form of one or more data and/or control signals. As also discussed more fully below, processor 22 is additionally designed to determine the centroid of at least one of the second elements $C_2$, $C_4$, $C_6$, and $C_8$ based on a second measured reflectance by sensor 16, which is also transmitted, conveyed, or communicated to processor 22, in the form of one or more data and/or control signals, as indicated by arrow 32.

As further discussed more fully below, processor 22 is designed to determine a print medium advance error based on the at least one determined centroid of first elements $C_1$, $C_3$, $C_5$, and $C_7$ and the at least one determined centroid of the interleaved second elements $C_2$, $C_4$, $C_6$, and $C_8$ of respective first pattern 26 and second pattern 28. Processor 22 can utilize this print medium advance error to actuate media control mechanism 14 to adjust for any detected error, for example, line feed errors such as over feed or under feed.

As can additionally be seen in FIG. 1, in this example of calibration apparatus 10, first pattern 26 of first elements $C_1$, $C_3$, $C_5$, and $C_7$ and second pattern 28 of interleaved second elements $C_2$, $C_4$, $C_6$, and $C_8$ define interleaved chevrons 34. It is to be understood, however, that in other examples of calibration apparatus 10, the first pattern of first elements $C_1$, $C_3$, $C_5$, and $C_7$ and the second pattern of interleaved second elements $C_2$, $C_4$, $C_6$, and $C_8$ may define other patterns (e.g., "Xs" or "Vs").

Figure 2:
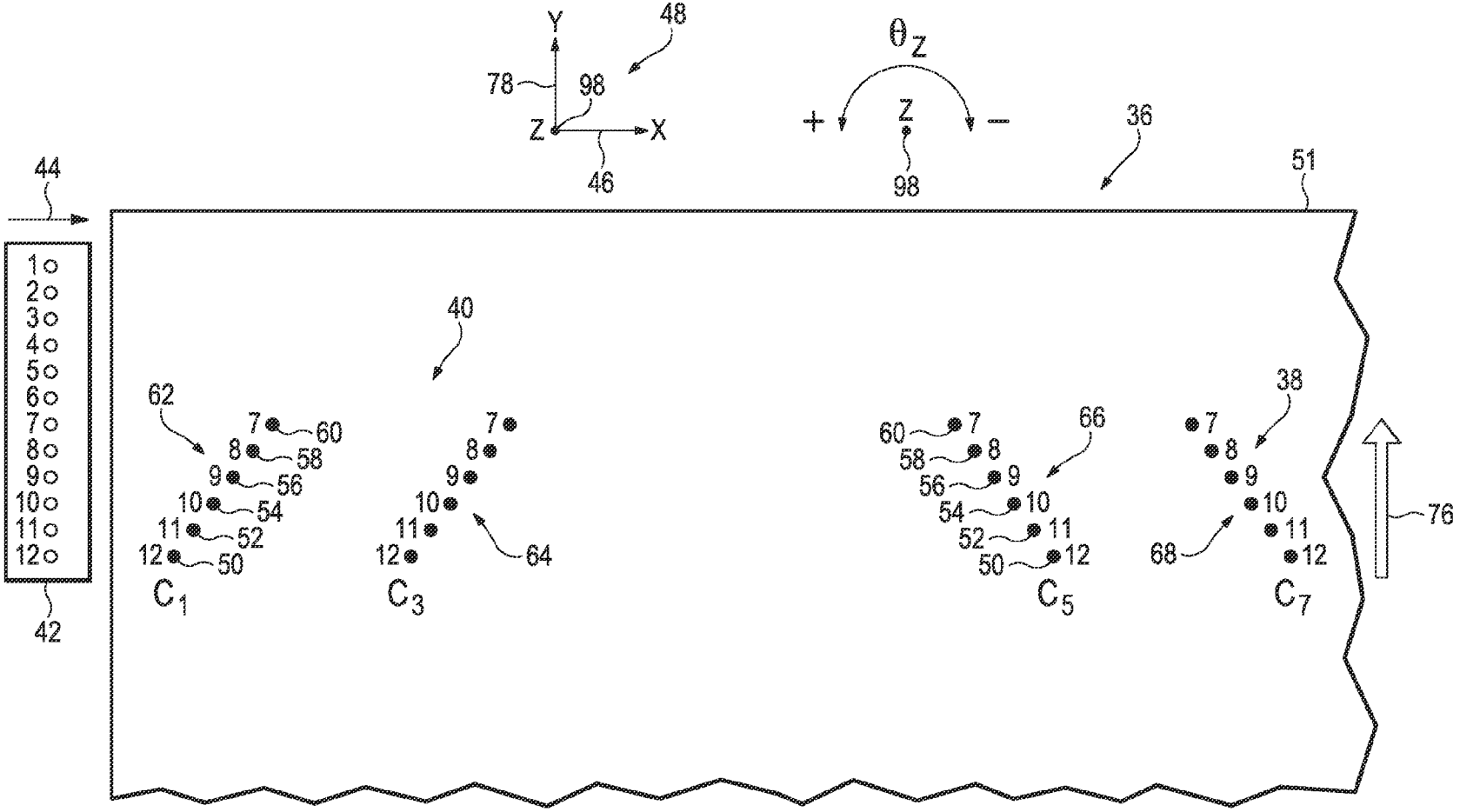
FIG. 2 is an example of a diagram of the printing of a first row of a first pattern of first elements.

An example of a diagram 36 of the printing of a first row 38 of a first pattern 40 of first elements $C_1$, $C_3$, $C_5$, and $C_7$ is shown in FIG. 2. As can be seen in FIG. 2, this printing occurs as a result of utilization of nozzles 7-12 in the lower portion of the illustrated printing mechanism 42 (a simplified ink jet print head with twelve nozzles 1-12) during movement in the direction generally indicated by arrow 44. This movement of printing mechanism 42 in the direction indicated by arrow 44 is substantially parallel to x-axis 46 of Cartesian coordinate system 48. More specifically, as printing mechanism 42 is moved in the x-axis 46 direction, nozzle 12 is activated to deposit a drop 50 on a print medium 51, followed by drop 52 from nozzle 11 after further movement of printing mechanism 42 in direction 44, through drop 60 from nozzle 7, thereby creating a diagonal line 62 of first element $C_1$, as shown.

Diagonal line 64 corresponding to first element $C_3$ is similarly created. Diagonal line 66 corresponding to first element $C_5$ is created by first activating nozzle 7 to deposit a drop 60 onto print medium 51, followed by a drop 58 from nozzle 8 after further movement of printing mechanism 42 in direction 44, through drop 50 from nozzle 12, thereby creating diagonal line 66. Diagonal line 68 corresponding to first element $C_7$ is similarly created. Although not shown, it is to be understood that additional first elements $C_9$-$C_M$ may be created, if desired.

As can be seen in FIG. 2, diagonal lines 62 and 64 are substantially parallel to one another and angled in a first direction. As can also be seen in FIG. 2, diagonal lines 66 and 68 are substantially parallel to one another and angled in a second direction.

Figure 3:
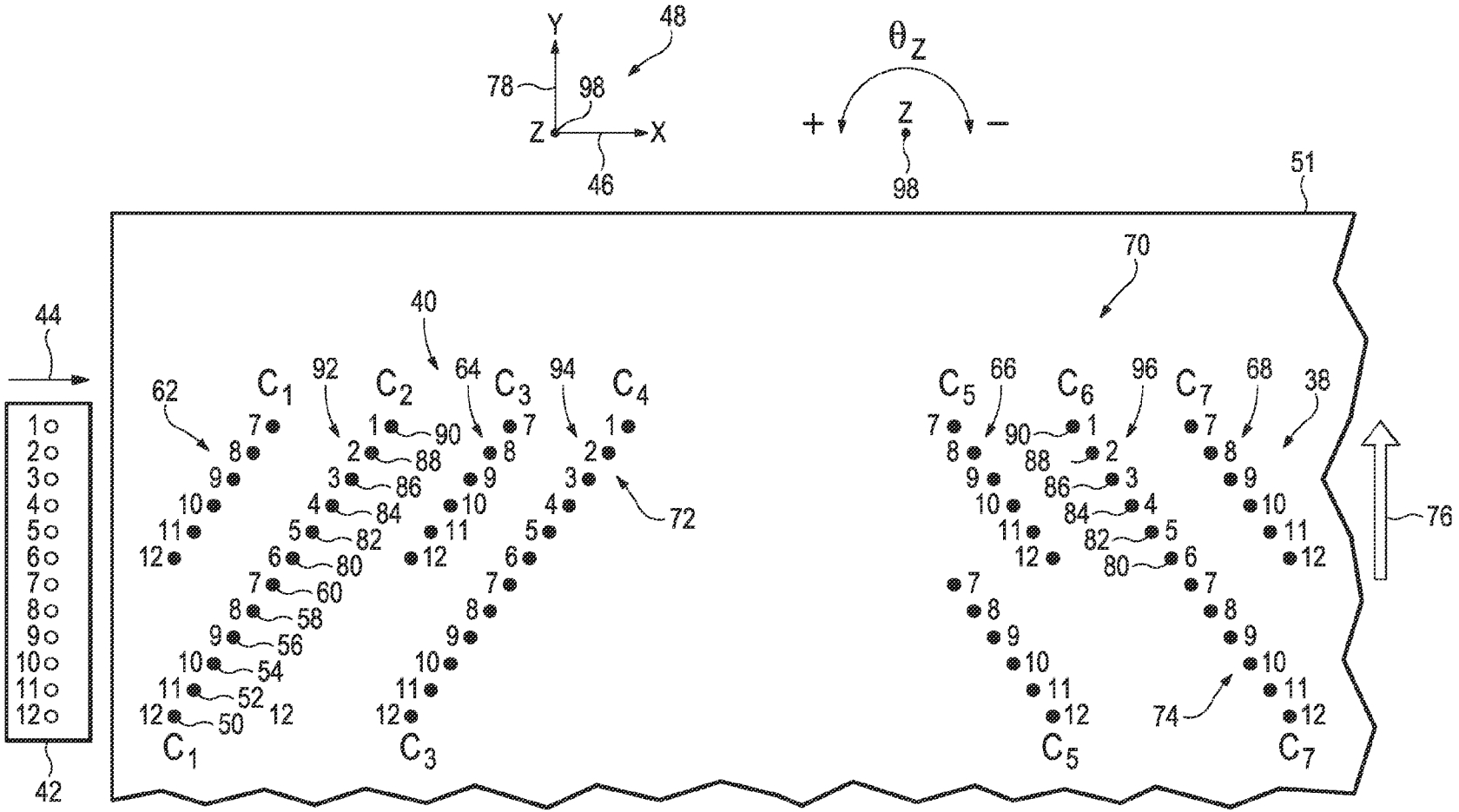
FIG. 3 is an example of a diagram of the printing of a second pattern of second elements in the first row and the printing of the first pattern of first elements in a second row.

An example of a diagram 70 of the printing of a second pattern 72 of interleaved second elements $C_2$, $C_4$, and $C_6$ in first row 38 and first pattern 40 of first elements $C_1$, $C_3$, $C_5$, and $C_7$ in a second row 74 subsequent to advancement of print medium 51 by a media control mechanism and processor (not shown) in the general direction of arrow 76 is shown in FIG. 3. This movement of print medium 51 in the direction indicated by arrow 76 is substantially parallel to y-axis 78 of Cartesian coordinate system 48. As can be seen in FIG. 3, in this example, second elements $C_2$, $C_4$, and $C_6$ of second pattern 72 are interleaved with first elements $C_1$, $C_3$, $C_5$, and $C_7$ of first pattern 40.

The printing of second pattern 72 occurs as a result of utilization of nozzles 1-6 in the upper portion of the illustrated printing mechanism 42 during movement in the direction generally indicated by arrow 44. More specifically, as printing mechanism 42 is moved in the x-axis 46 direction, nozzle 6 is activated to deposit a drop 80 on a print medium (not shown), followed by drop 82 from nozzle 5 after further movement of printing mechanism 42 in direction 44, through drop 90 from nozzle 1, thereby creating a diagonal line 92 of second element $C_2$, as shown.

Diagonal line 94 corresponding to second element $C_4$ is similarly created. Diagonal line 96 corresponding to second element $C_6$ is created by first activating nozzle 1 to deposit a drop 90 onto print medium 51, followed by a drop 88 from nozzle 2 after further movement of printing mechanism 42 in direction 44, through drop 80 from nozzle 6, thereby creating diagonal line 96. Although not shown, a diagonal line corresponding to second element $C_8$ may be similarly created. Additionally, although not shown, it is to be understood that further second elements $C_{10}$-$C_N$ may be created, if desired.

As can also be seen in FIG. 3, diagonal lines 92 and 94 are substantially parallel to one another and angled in a first direction. As can additionally be seen in FIG. 3, diagonal line 96 is angled in a second direction.

As can further be seen in FIG. 3, first pattern 40 of first elements $C_1$, $C_3$, $C_5$, and $C_7$ in a second row 74 can be printed during the printing of second pattern 72 of second elements $C_2$, $C_4$, and $C_6$. That is, nozzles 12-7 of printing mechanism 44 can deposit respective drops 50-60 onto print medium 51 to create first elements $C_1$ and $C_3$ while nozzles 6-1 of printing mechanism 44 deposit respective drops 80-90 to create second elements $C_2$ and $C_4$. Similarly, nozzles 7-12 of printing mechanism 44 can deposit respective drops 60-50 onto print medium 51 to create first elements $C_5$ and $C_7$ while nozzles 1-6 of printing mechanism 44 deposit respective drops 90-80 to create second element $C_6$ and also possibly $C_8$.

Cartesian coordinate system 48 also includes a z-axis 98 that is substantially perpendicular to the plane formed by x-axis 46 and y-axis 78. It is therefore illustrated as point in FIG. 3, indicating that it extends out of FIG. 3. Rotation about z-axis 98 is also illustrated in FIG. 3 as either a positive theta-z ($+\theta_z$) or a negative theta-z ($-\theta_z$). Theta-z rotation is relevant with respect to some printing mechanisms that can be used in calibration apparatus 10, such as ink jet print heads, as discussed more fully below.

Figure 4:
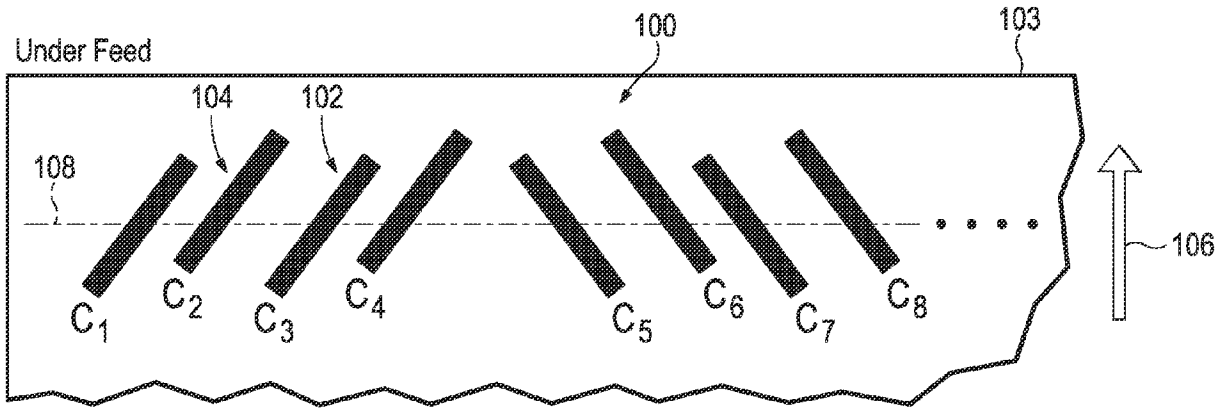
FIG. 4 is an example of a diagram illustrating under feed.

An example of a diagram 100 illustrating under feed is shown in FIG. 4. As can be seen in FIG. 4, first elements $C_1$, $C_3$, $C_5$, and $C_7$ of a first pattern 102 have been printed on a print medium 103 by a printing mechanism and processor of calibration apparatus 10 (not shown). Additionally, subsequent to advancement of print medium 103 in the y-axis direction generally indicated by arrow 106, second elements $C_2$, $C_4$, $C_6$, and $C_8$ of a second pattern 104 have also been printed on print medium 103 and interleaved with first elements $C_1$, $C_3$, $C_5$, and $C_7$. Although not shown, it is to be understood that additional first and/or second elements $C_9$, $C_{10}$, $C_{11}$, $C_{12}$, . . . $C_M$, $C_N$ may be printed as well.

As can be seen in FIG. 4, second elements $C_2$, $C_4$, $C_6$, and $C_8$ of second pattern 104 are above first elements $C_1$, $C_3$, $C_5$, and $C_7$ of first pattern 102, as indicated by dashed line 108, because of an under feed error during advancement of print medium 103 in the direction of arrow 106 by the media control mechanism. As discussed above, under feed error can manifest itself as a print quality defect known as dark line banding. Calibration apparatus 10 is designed to detect this under feed error via a sensor, such as sensor 16, which transmits or otherwise communicates reflectance data to a processor, such as processor 22. As discussed above and described in more detail below, the processor can then utilize this data to determine a centroid of at least one of first elements $C_1$, $C_3$, $C_5$, and $C_7$, determine the centroid of at least one of second elements $C_2$, $C_4$, $C_6$, and $C_8$, and determine the print media advance error. The processor can then utilize this determined print media advance error to actuate a media control mechanism, such as media control mechanism 14, to compensate for this under feed error and correct this dark line banding error, thereby improving output print quality.

Figure 5:
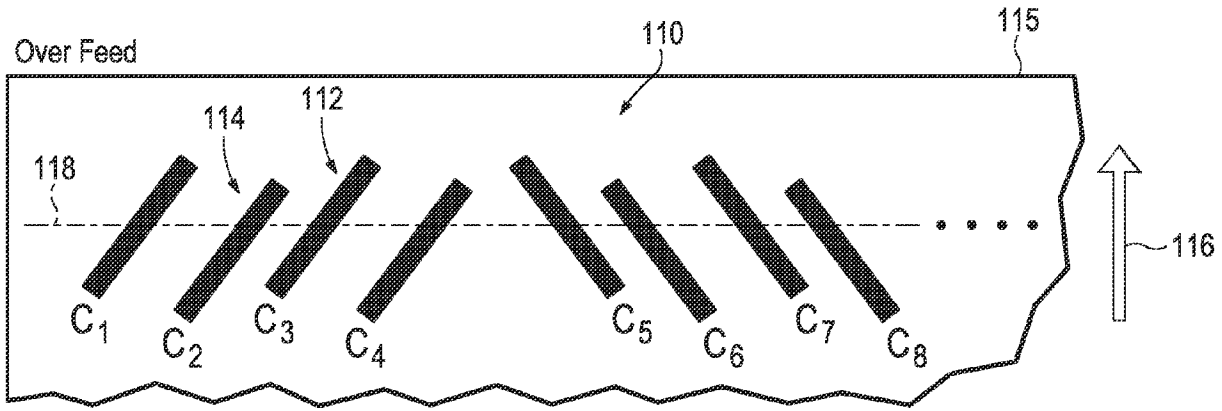
FIG. 5 is an example of a diagram illustrating over feed.

An example of a diagram 110 illustrating over feed is shown in FIG. 5. As can be seen in FIG. 5, first elements $C_1$, $C_3$, $C_5$, and $C_7$ of a first pattern 112 have been printed on a print medium 115 by a printing mechanism and processor of calibration apparatus 10 (not shown). Additionally, subsequent to advancement of print medium 115 in the y-axis direction generally indicated by arrow 116, second elements $C_2$, $C_4$, $C_6$, and $C_8$ of a second pattern 114 have also been printed on print medium 115 and interleaved with first elements $C_1$, $C_3$, $C_5$, and $C_7$. Although not shown, it is to be understood that additional first and/or second elements $C_9$, $C_{10}$, $C_{11}$, $C_{12}$, . . . $C_M$, $C_N$ may be printed as well.

As can be seen in FIG. 5, second elements $C_2$, $C_4$, $C_6$, and $C_8$ of second pattern 114 are below first elements $C_1$, $C_3$, $C_5$, and $C_7$ of first pattern 112, as indicated by dashed line 118, because of an over feed error during advancement of print medium 115 in the direction of arrow 116 by the media control mechanism. As discussed above, over feed error can manifest itself as a print quality defect known as white line banding. Calibration apparatus 10 is designed to detect this over feed error via a sensor, such as sensor 16, which transmits or otherwise communicates reflectance data to a processor, such as processor 22. As discussed above and described in more detail below, the processor can then utilize this data to determine a centroid of at least one of first elements $C_1$, $C_3$, $C_5$, and $C_7$, determine the centroid of at least one of second elements $C_2$, $C_4$, $C_6$, and $C_8$, and determine the print media advance error. The processor can then utilize this determined print media advance error to actuate a media control mechanism, such as media control mechanism 14, to compensate for this over feed error and correct this white line banding error, thereby improving output print quality.

Figure 6:
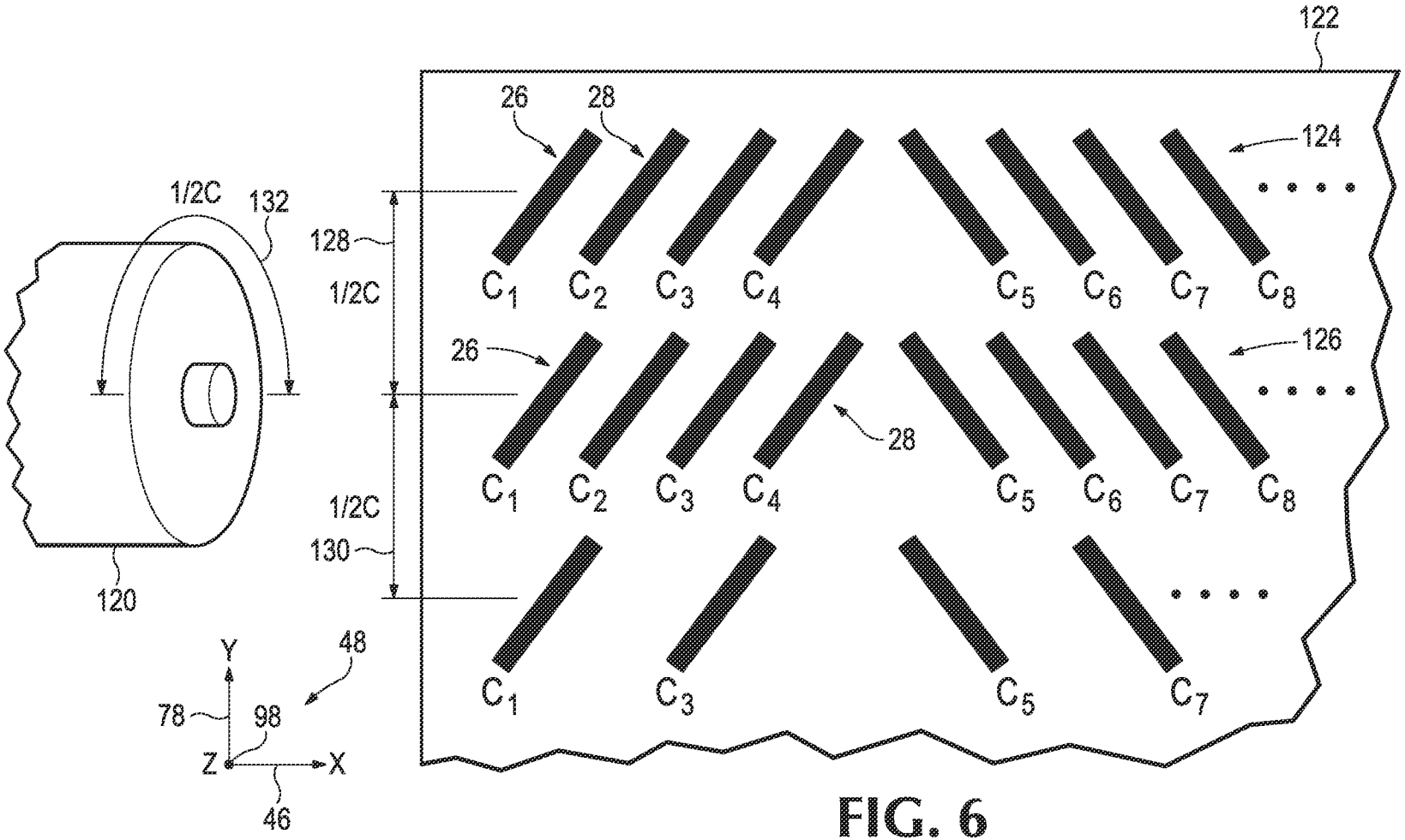
FIG. 6 is diagrammatic illustration of an example of the determination or calculation of a print medium advance error.

An example of the determination or calculation of the print medium advance error is diagrammatically illustrated in FIG. 6. A media advance roller 120 is shown that is part of a media control mechanism, such as media control mechanism 14. Media advance roller 120 is intended to represent the final element of the media control mechanism that advances print media past a printing mechanism, such as printing mechanism 12. The respective first and second patterns of elements, such as patterns 26 and 28, for example, may be designed around a period of media advance roller 120. That is, a print medium 122 may be advanced a distance by the media control mechanism that is substantially equal to a predetermined amount of a length of a circumference of media advance roller 120 and the print medium advance error determined based on this distance.

For example, as shown in FIG. 6, two rows (i.e., first row 124 and second row 126) of respective interleaved first and second patterns of elements 26 and 28 may be printed on print medium 122 that are spaced such that each row is printed at one-half (½) of the circumference ("C") of media advance roller 120, as shown by lead-line and reference numerals 128 and 130. That is, media advance roller 120 is actuated to rotate one-half of its circumference (½C), as indicated by lead-line and reference numeral 132. These patterns may be scanned by a sensor, such as sensor 16, in the direction of x-axis 46, as discussed above, and the centroid determined for at least one of first elements $C_1$, $C_3$, $C_5$, and $C_7$, and at least one of second elements $C_2$, $C_4$, $C_6$, and $C_8$ by a processor, such as processor 22, as also discussed above. The print medium advance error may then be determined or calculated as follows, where $X_1$ represents the centroid for element $C_1$, $X_2$ represents the centroid for element $C_2$, $X_3$ represents the centroid for element $C_3$, $X_4$ represents the centroid for element $C_4$, $X_5$ represents the centroid for element $C_5$, $X_6$ represents the centroid for element $C_6$, $X_7$ represents the centroid for element $C_7$, $X_8$ represents the centroid for element $C_8$, and the centroid is determined for all of elements $C_1$ through $C_8$:

$$\text{Print medium advance error}=[(X_2-X_1)+(X_4-X_3)+(X_5-X_6)+(X_7-X_8)]/4.$$

Additional accuracy or precision may be obtained by averaging print medium advance error over a plurality of rows or lines. For example, twelve rows or lines of first and second patterns of elements, such as interleaved first and second patterns of elements 26 and 28, may be printed on a print medium, such as print medium 122, that are spaced such that each row is printed at one-half (½) of the circumference of media advance roller 120 and the print medium advance error determined for each line or row, as discussed above. The results may then be averaged by adding up all twelve (12) lines of print medium advance error and then dividing by six (6) to obtain an average for six (6) full revolutions of media advance roller 120 (two (2) print medium 122 advances of ½C per one (1) revolution of media advance roller 120).

It should be noted that in other examples, the print media advance error may be averaged over more than twelve (12) lines or rows of first and second patterns of elements to obtain even greater accuracy or precision. If less accuracy or precision is required or desired, less than twelve (12) lines or rows (e.g., six (6)) may be utilized. Similarly, more than two rows of respective interleaved first and second patterns of elements 26 and 28 may be printed on print medium 122 that are spaced such that each row is printed at less than one-half (½) of the circumference ("C") of media advance roller 120 (e.g., ¼C). That is, media advance roller 120 may be actuated to rotate one-fourth of its circumference (¼C) so that each printed row of interleaved patterns of elements has a spacing of ¼C. These patterns may then be scanned by a sensor, such as sensor 16, as discussed above, and the centroid determined for each of elements $C_1$, $C_2$, $C_3$, $C_4$, $C_5$, $C_6$, $C_7$, and $C_8$ by a processor, such as processor 22, as also discussed above. The print medium advance error may then be determined or calculated, as illustrated above.

Figure 7:
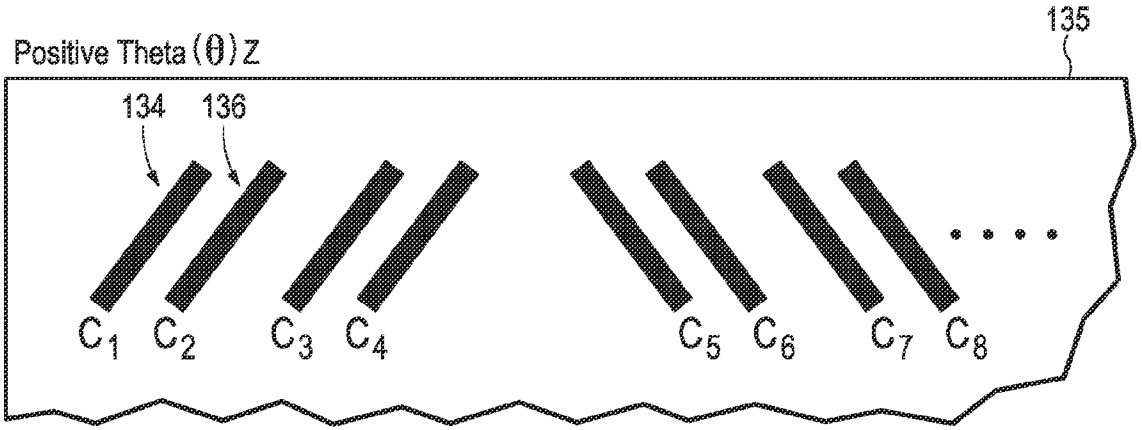
FIG. 7 is an example of a diagram illustrating positive theta-z ($+\theta_z$) error.

An example of a diagram illustrating positive theta-z ($+\theta_z$) error is shown in FIG. 7. As can be seen in FIG. 7, first elements $C_1$, $C_3$, $C_5$, and $C_7$ of a first pattern 134 have been printed on a print medium 135 by a printing mechanism and processor of calibration apparatus 10 (not shown). Additionally, subsequent to advancement of print medium 135 in the y-axis direction 78, second elements $C_2$, $C_4$, $C_6$, and $C_8$ of a second pattern 136 have also been printed on print medium 135 and interleaved with first elements $C_1$, $C_3$, $C_5$, and $C_7$. Although not shown, it is to be understood that additional first and/or second elements $C_9$, $C_{10}$, $C_{11}$, $C_{12}$, . . . $C_M$, $C_N$ may be printed as well.

As can be seen in FIG. 7, first elements $C_1$, $C_3$, $C_5$, and $C_7$ of first pattern 134 have moved or shifted to the right with respect to second elements $C_2$, $C_4$, $C_6$, and $C_8$ of second pattern 136 as a result of this positive theta-z ($+\theta_z$) error. This error results from certain printing mechanisms that can be used in calibration apparatus 10, such as ink jet print heads, that may be rotated in a transport mechanism, such as a carriage, about z-axis 98. However, the respective interleaved first and second patterns of the calibration apparatus, such as respective first and second patterns 134 and 136 of calibration apparatus 10, have been designed to accommodate, compensate, or account for this error during determination or calculation of the print medium advance error. That is, any difference between adjacent centroids of element patterns will be positively correlated and cancelled out during the print medium advance error determination or calculation.

For example, if $E_1=(X_2-X_1)$, $E_2=(X_4-X_3)$, $E_3=(X_6-X_5)$, and $E_4=(X_8-X_7)$, then the E1 and E2 errors would be positively correlated with the E3 and E4 errors and, therefore, cancelled out in determination of any print medium advance error. That is, as discussed above, for example:

$$\begin{aligned}\text{Print medium advance error} &= \frac{\begin{bmatrix}(X_2-X_1)+(X_4-X_3)+\\(X_5-X_6)+(X_7-X_8)\end{bmatrix}}{4}\\ &= \frac{[(E_1)+(E_2)-(E_3)-(E_4)]}{4}\\ &= \frac{[(E_1+E_2)-(E_3+E_4)]}{4}.\end{aligned}$$

Figure 8:
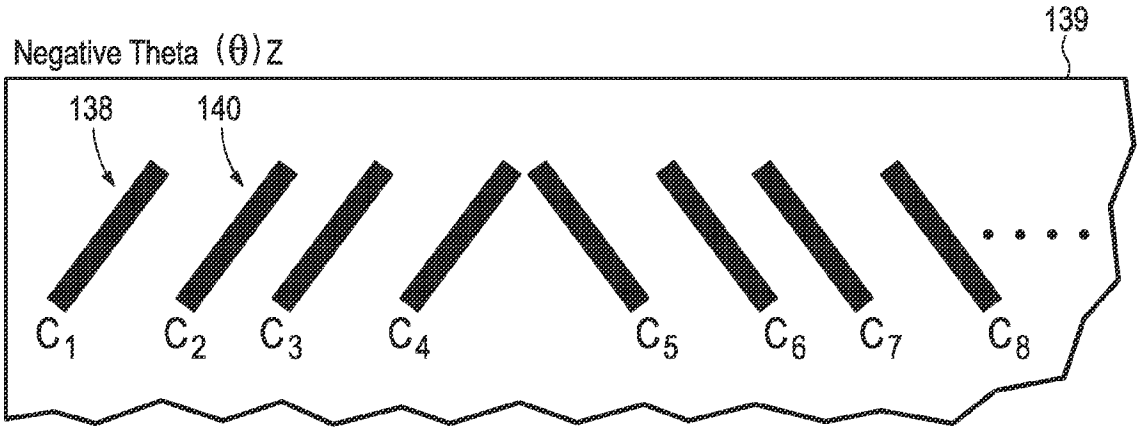
FIG. 8 is an example of a diagram illustrating negative theta-z ($-\theta_z$) error.

An example of a diagram illustrating negative theta-z ($-\theta_z$) error is shown in FIG. 8. As can be seen in FIG. 8, first elements $C_1$, $C_3$, $C_5$, and $C_7$ of a first pattern 138 have been printed on a print medium 139 by a printing mechanism and processor of calibration apparatus 10 (not shown). Additionally, subsequent to advance of print medium 139 in the y-axis direction 78, second elements $C_2$, $C_4$, $C_6$, and $C_8$ of a second pattern 140 have also been printed on print medium 139 and interleaved with first elements $C_1$, $C_3$, $C_5$, and $C_7$. Although not shown, it is to be understood that additional first and/or second elements $C_9$, $C_{10}$, $C_{11}$, $C_{12}$, . . . $C_M$, $C_N$ may be printed as well.

As can be seen in FIG. 8, first elements $C_1$, $C_3$, $C_5$, and $C_7$ of first pattern 138 have moved or shifted to the left with respect to second elements $C_2$, $C_4$, $C_6$, and $C_8$ of second pattern 140 as a result of this negative theta-z ($-\theta_z$) error. This error results from certain printing mechanisms that can be used in calibration apparatus 10, such as ink jet print heads, that may be rotated in a transport mechanism, such as a carriage, about z-axis 98. However, the respective interleaved first and second patterns of the calibration apparatus, such as respective first and second patterns 138 and 140 of calibration apparatus 10, have been designed to accommodate, compensate, or account for this error during determination or calculation of the print medium advance error. That is, any difference between adjacent centroids of element patterns will be positively correlated and cancelled out during the print medium advance error determination or calculation.

For example, if $E_1=(X_2-X_1)$, $E_2=(X_4-X_3)$, $E_3=(X_6-X_5)$, and $E_4=(X_8-X_7)$, then the E1 and E2 errors would be positively correlated with the E3 and E4 errors and, therefore, cancelled out in determination of any print medium advance error. That is, as discussed above, for example:

$$\begin{aligned}\text{Print medium advance error} &= \frac{\begin{bmatrix}(X_2-X_1)+(X_4-X_3)+\\(X_5-X_6)+(X_7-X_8)\end{bmatrix}}{4}\\ &= \frac{[(E_1)+(E_2)-(E_3)-(E_4)]}{4}\\ &= \frac{[(E_1+E_2)-(E_3+E_4)]}{4}.\end{aligned}$$

There are additional advantages to the first pattern of first elements and interleaved pattern of second elements of the calibration apparatus for use in a printing device. For example, it helps to control and minimize vibration of the printing mechanism in the x-axis direction, caused by things such as the carriage. This is because the elements of the pattern are spaced close enough apart that there are enough reflectance measurements in a typical vibration period that such vibration does not affect print medium advance error determination. As another example, it has been determined that the first pattern of first elements and interleaved pattern of second elements are not adversely affected by luminance variation across print medium. This variation can occur during sensor scanning across a print medium.

Figure 9:
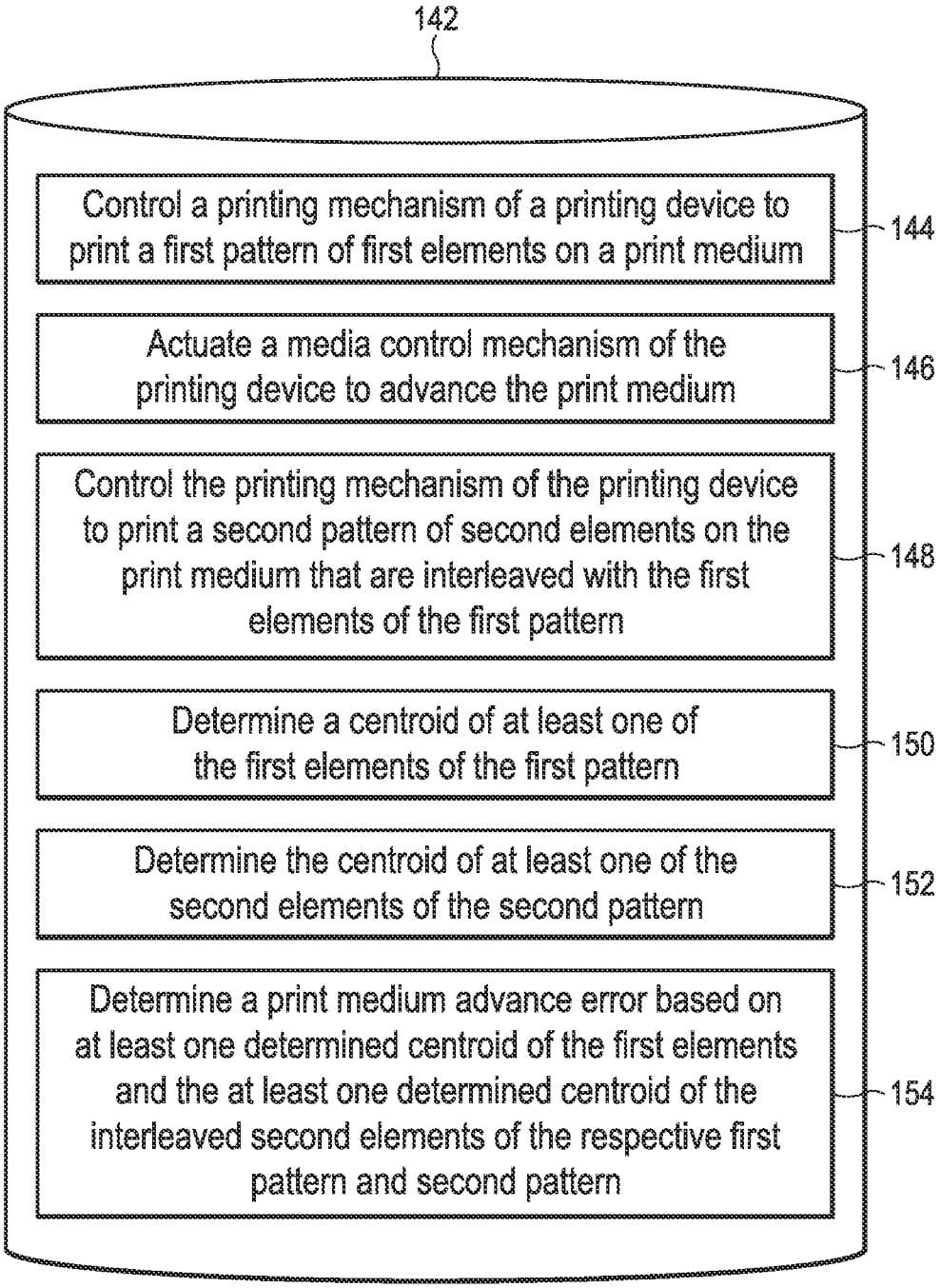
FIG. 9 is an illustration of an example of a non-volatile storage medium.

An illustration of an example of a non-volatile storage medium 142 is shown in FIG. 9. As can be seen in FIG. 9, non-volatile storage medium 142 includes instructions that, when executed by a processor, such as processor 22, cause the processor to control a printing mechanism of a printing device to print a first pattern of first elements on a print medium, as generally indicated by block 144, and actuate a media control mechanism of the printing device to advance the print medium, as generally indicated by block 146. Non-volatile storage medium 142 includes additional instructions that, when executed by the processor, cause the processor to control the printing mechanism of the printing device to print a second pattern of second elements on the print medium that are interleaved with the first elements of the first pattern, determine a centroid of at least one of the first elements of the first pattern, and determine the centroid of at least one of the second elements of the second pattern, as generally indicated by respective blocks 148, 150, and 152 in FIG. 9. As can additionally be seen in FIG. 9, non-volatile storage medium 142 includes further instructions that, when executed by the processor, cause the processor to determine a print medium advance error based on the at least one determined centroid of the first elements and the at least one determined centroid of the interleaved second elements of the respective first pattern and second pattern, as generally indicated by block 154.

Figure 10:
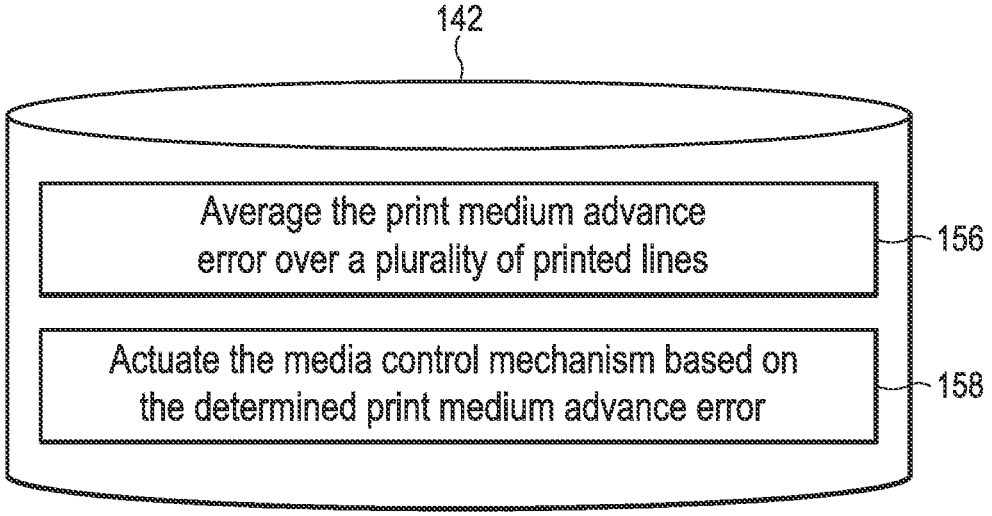
FIG. 10 is an illustration of an example of additional instructions on the non-volatile storage medium of FIG. 9.

An illustration of an example of additional instructions on non-volatile storage medium 142 is shown in FIG. 10. The print media advance error may be determined for each line of the first pattern of first elements and the second pattern of interleaved second elements printed on the print media. In such cases, non-volatile storage medium 142 may include additional instructions that, when executed by the processor, cause the processor to average the print medium advance error over a plurality of printed lines, as generally indicated by block 156. Alternatively or additionally, non-volatile storage medium 142 further additional instructions that, when executed by the processor, cause the processor to actuate the media control mechanism based on the determined print medium advance error, as generally indicated by block 158.

Figure 11:
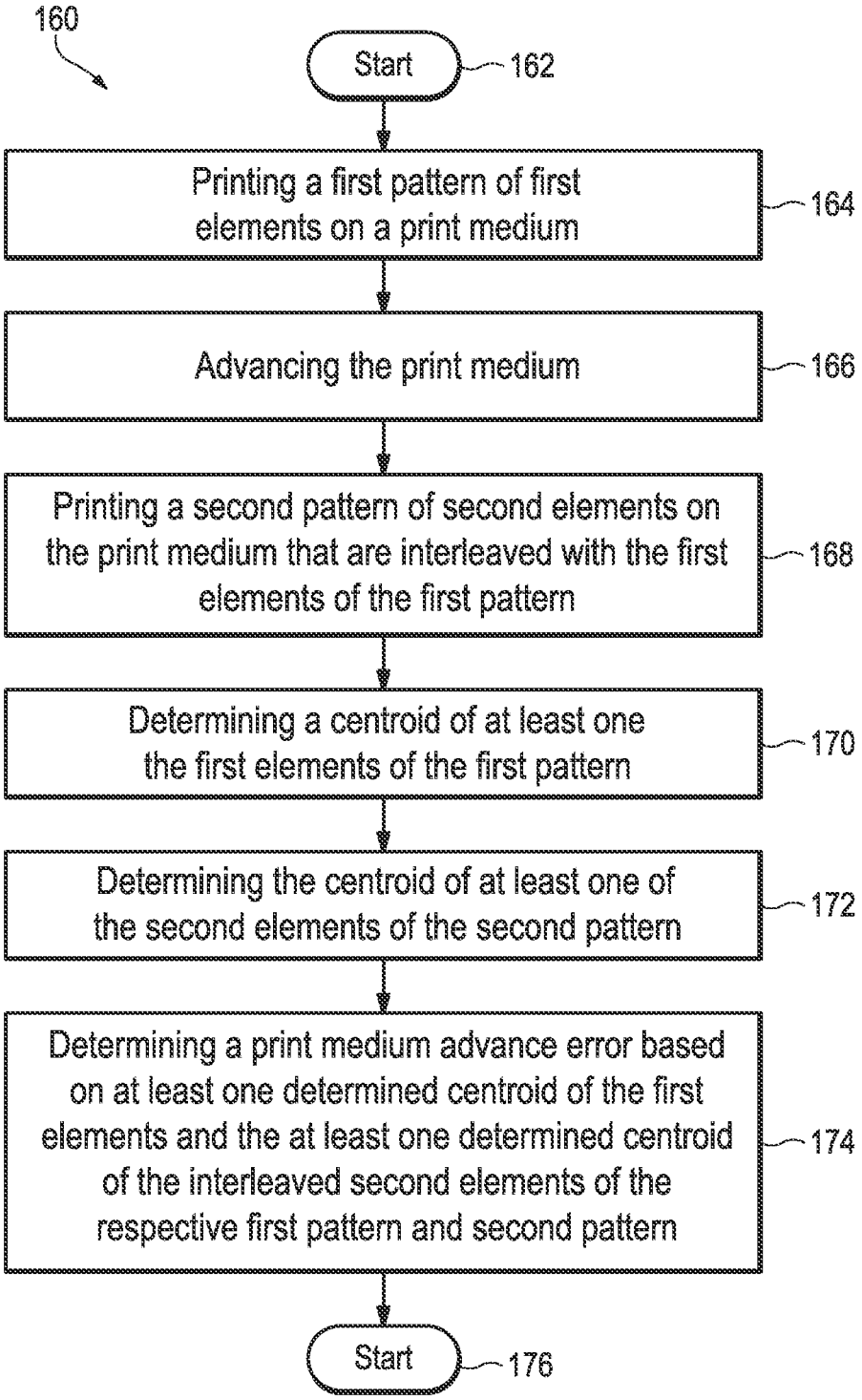
FIG. 11 is an illustration of an example of a calibration method for use in a printing device.

An illustration of an example of a calibration method 160 for use in a printing device is shown in FIG. 11. As can be seen in FIG. 11, calibration method 160 starts or begins 162 by printing a first pattern of first elements on a print medium, advancing the print medium, and printing a second pattern of second elements on the print medium that are interleaved with the first elements of the first pattern, as indicated by respective blocks 164, 166, and 168. Calibration method 160 may continue by determining a centroid of at least one the first elements of the first pattern, as indicated by block 170, and determining the centroid of at least one of the second elements of the second pattern, as indicated by block 172. Calibration method 160 may additionally continue by determining a print medium advance error based on the at least one determined centroid of the first elements and the at least one determined centroid of the interleaved second elements of the respective first pattern and second pattern, as indicated by block 174. Method 160 may then end 176.

Figure 12:
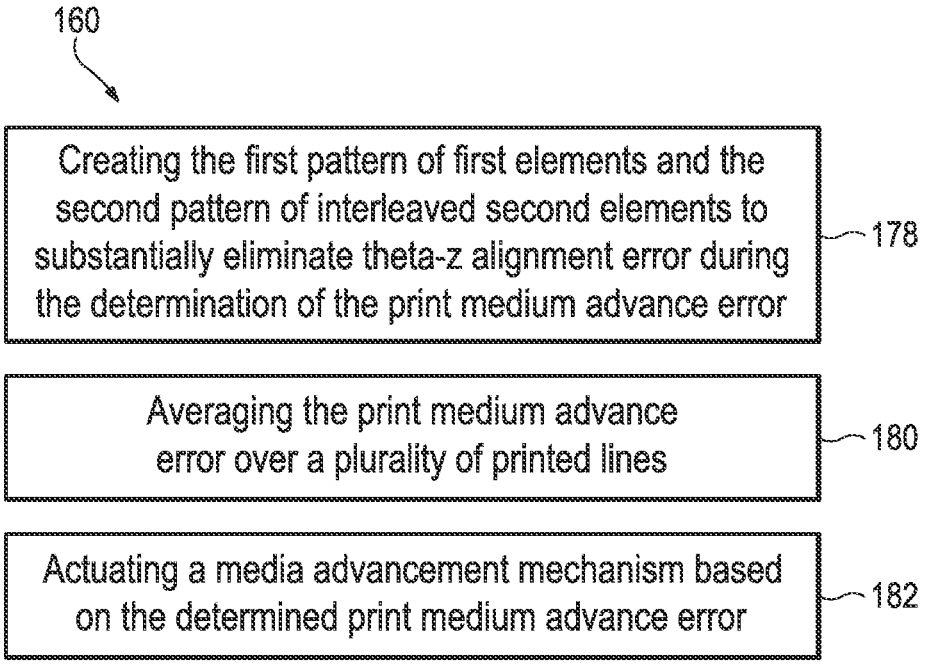
FIG. 12 is an illustration of an example of additional elements of the calibration method of FIG. 11.

An illustration of an example of additional elements of calibration method 160 is shown in FIG. 12. As can be seen in FIG. 12, calibration method 160 may include creating the first pattern of first elements and the second pattern of interleaved second elements to substantially eliminate theta-z alignment error during the determination of the print medium advance error, as indicated by block 178. In some examples, the print media advance error may be determined for each line of first pattern of first elements and second pattern of interleaved second elements printed on the print media. In such cases, calibration method 160 may include averaging the print medium advance error over a plurality of printed lines, as indicated by block 180. As can further be seen in FIG. 12, calibration method 160 may alternatively or additionally include actuating a media advancement mechanism based on the determined print medium advance error, as indicated by block 182.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A calibration apparatus for use in a printing device, comprising:

a printing mechanism;

a media control mechanism;

a sensor; and a processor to control the printing mechanism to print only a first pattern of first elements on a print medium and subsequently only a second pattern of second elements on the print medium that are spaced apart and interleaved with the first elements of the first pattern, to actuate the media control mechanism to advance the print medium prior to the printing of the second pattern, to determine a centroid of at least one of the first elements of the first pattern based on a first measured reflectance by the sensor, to separately determine a centroid of at least one of the second elements of the second pattern based on a second measured reflectance by the sensor, and to determine a print medium advance error based on the at least one determined centroid of the first elements and the at least one separately determined centroid of the interleaved second elements of the respective first pattern and second pattern, wherein the print media advance error is determined for each line of the first pattern of first elements and the second pattern of spaced apart and interleaved second elements printed on the print media.

2. The calibration apparatus of claim 1, wherein the spaced apart and interleaved second pattern of second elements is printed on the print medium subsequent to a period advancement of the print medium by the media control mechanism.

3. The calibration apparatus of claim 1, wherein the first pattern of first elements and the second pattern of spaced apart and interleaved second elements define interleaved chevrons.

4. The calibration apparatus of claim 1, wherein the first pattern of first elements and the second pattern of spaced apart and interleaved second elements are created to substantially eliminate theta-z alignment error of the printing mechanism during the determination of the print medium advance error.

5. The calibration apparatus of claim 1, wherein the print medium is advanced a distance by the media control mechanism substantially equal to a predetermined amount of a length of a circumference of a media advance roller of the media control mechanism, and further wherein the print medium advance error is determined based on the distance.

6. The calibration apparatus of claim 1, wherein the processor averages the print medium advance error over a plurality of printed lines.

7. The calibration apparatus of claim 1, wherein the processor actuates the media control mechanism based on the determined print medium advance error.

8. The calibration apparatus of claim 1, wherein the print medium advance error includes one of an over feed and an under feed.

9. The calibration apparatus of claim 1, wherein the first pattern of first elements includes a plurality of diagonal lines and the second pattern of second elements includes a plurality of diagonal lines spaced apart from the first pattern such that reflectance measurements by the sensor in a vibration period of the printing mechanism does not affect the print medium advance error.

10. A non-transitory storage medium including instructions that, when executed by a processor, cause the processor to:

control a printing mechanism of a printing device to print only a first pattern of first elements on a print medium;

actuate a media control mechanism of the printing device to advance the print medium;

control the printing mechanism of the printing device to print only a second pattern of second elements on the print medium that are spaced apart and interleaved with the first elements of the first pattern;

determine a centroid of at least one of the first elements of the first pattern;

separately determine the centroid of at least one of the second elements of the second pattern; and determine a print medium advance error based on the at least one determined centroid of the first elements and the at least one separately determined centroid of the interleaved second elements of the respective first pattern and second pattern, wherein the print media advance error is determined for each line of first pattern of first elements and second pattern of spaced apart and interleaved second elements printed on the print media.

11. The non-transitory storage medium of claim 10, further comprising additional instructions that, when executed by the processor, cause the processor to average the print medium advance error over a plurality of printed lines.

12. The non-transitory storage medium of claim 10, further comprising additional instructions that, when executed by the processor, cause the processor to actuate the media control mechanism based on the determined print medium advance error.

13. The non-transitory storage medium of claim 10, wherein the spaced apart and interleaved second pattern of second elements is printed on the print medium subsequent to a period advancement of the print medium.

14. The non-transitory storage medium of claim 10, wherein the first pattern of first elements and the second pattern of spaced apart and interleaved second elements define interleaved chevrons.

15. The non-transitory storage medium of claim 10, wherein the first pattern of first elements and the second pattern of spaced apart and interleaved second elements are created to substantially eliminate theta-z alignment error during the determination of the print medium advance error.

16. The non-transitory storage medium of claim 10, wherein the print medium is advanced a distance substantially equal to a predetermined amount of a length of a circumference of a media advance roller of the media control mechanism, and further wherein the print medium advance error is determined based on the distance.

17. A calibration method for use in a printing device, the method executed by a processor coupled to a non-transitory storage medium having instructions that when read and executed by the processor cause the processor to perform the steps, comprising:

printing only a first pattern of first elements on a print medium;

advancing the print medium;

subsequently printing only a second pattern of second elements on the print medium that are spaced apart and interleaved with the first elements of the first pattern;

determining a centroid of at least one the first elements of the first pattern;

separately determining the centroid of at least one of the second elements of the second pattern; and determining a print medium advance error based on the at least one determined centroid of the first elements and the at least one separately determined centroid of the interleaved second elements of the respective first pattern and second pattern, wherein the print media advance error is determined for each line of the first pattern of first elements and the second pattern of spaced apart and interleaved second elements printed on the print media.

18. The calibration method of claim 17, further comprising creating the first pattern of first elements and the second pattern of spaced apart and interleaved second elements to substantially eliminate theta-z alignment error during the determination of the print medium advance error.

19. The calibration method of claim 17, further comprising averaging the print medium advance error over a plurality of printed lines.

20. The calibration method of claim 17, further comprising actuating a media advancement mechanism based on the determined print medium advance error.

* * * * *